United States Patent [19]

Rotondi et al.

[11] Patent Number: 4,593,542

[45] Date of Patent: Jun. 10, 1986

[54] DEADBOLT ASSEMBLY HAVING SELECTABLE BACKSET DISTANCE

[75] Inventors: Anthony J. Rotondi, Whittier; Richard O. Mullich, Burbank; George F. Carabet, Rancho Palos Verdes, all of Calif.

[73] Assignee: TRE Corporation, Los Angeles, Calif.

[21] Appl. No.: 518,448

[22] Filed: Jul. 29, 1983

[51] Int. Cl.[4] ..... E05B 63/06

[52] U.S. Cl. ..... 70/134; 70/461; 292/139; 292/337; 292/DIG. 60

[58] Field of Search ..... 70/129, 134, 143, 461, 70/447–449, 451; 292/337, 1, DIG. 44, DIG. 60, 139, 167, 169.21–169.23, 169.13, 169

[56] References Cited

U.S. PATENT DOCUMENTS

| | | | |
|---|---|---|---|
| 170,353 | 11/1875 | Drucklieb | 70/143 |
| 1,549,602 | 8/1925 | Murmann | 70/449 X |
| 1,724,630 | 8/1929 | Wilson | 292/337 X |
| 1,846,364 | 2/1932 | Schlage | 70/134 |
| 2,390,756 | 12/1945 | Voight | 292/169.22 |
| 3,699,788 | 10/1972 | Gerlach et al. | 70/134 |
| 4,372,594 | 2/1983 | Gater | 292/337 |
| 4,427,224 | 1/1984 | Bergen | 292/169.23 |
| 4,446,707 | 5/1984 | Mullich et al. | 70/134 |

FOREIGN PATENT DOCUMENTS

| | | | |
|---|---|---|---|
| 234247 | 5/1911 | Fed. Rep. of Germany | 70/134 |

*Primary Examiner*—Robert L. Wolfe
*Assistant Examiner*—Russell W. Illich
*Attorney, Agent, or Firm*—Spensley Horn Jubas & Lubitz

[57] ABSTRACT

An improved deadbolt lockset is provided in which one of two different backset distances is facilitated in a single latch assembly. At least one planar side plate coupled to a deadbolt extension is provided and is slidably contained within a hollow latch case. Movement of the side plate determines the distance from the face plate of the assembly to the axis of an actuating assembly. The latch case includes slots formed therein for positioning the actuating assembly and to allow movement of the side plates.

11 Claims, 12 Drawing Figures

DEADBOLT ASSEMBLY HAVING SELECTABLE BACKSET DISTANCE

BACKGROUND OF THE INVENTION

1. Field of the Invention

This invention relates to deadbolt type lockset assemblies. More particularly, this invention relates to a deadbolt type lockset in which one of two different backset distances may be selected prior to assembling the lockset in a door.

Deadbolt locksets typically are provided with one of two different backsets. The backset is the distance from the edge of the door to the actuating knob axis. The most common backset distances are 2⅜" and 2¾". In a new door, the customer must prepare the door by drilling for specific backset dimensions. In the replacement market, doors are already drilled and the customer must obtain a proper backset deadbolt lockset to match the pre-drilled door.

2. Description of the Prior Art

In the prior art, one of two completely separate deadbolt locksets were provided depending upon the desired backset. Several problems arise due to the use of separate deadbolt locksets. In the new construction market, the wrong backset may be specified by the customer or packaging and shipping errors may occur. The result in either case is that the customer will receive the wrong deadbolt for his project. In the retail market, there are a large number of products returned when the customer discovers that an error was made in the selection of a deadbolt for his application. Such errors result in a variety of losses after the seal of the package has been broken. Furthermore, the provision of two different deadbolt locksets creates problems of inventory maintenance.

U.S. Pat. No. 4,372,594 to Gater discloses a deadbolt lockset which can be adjusted to provide either a 2⅜" or a 2¾" backset distance. The lockset includes a telescopic deadbolt connected to a deadbolt actuating mechanism. Without adjusting the deadbolt actuating mechanism, the deadbolt can be lengthened or shortened to provide the desired backset distance.

Copending U.S. patent application Ser. No. 485,180, filed Apr. 18, 1983 and assigned to TRE Corporation, discloses a spring latch-type lockset also having a selectable backset distance.

SUMMARY OF THE INVENTION

The present invention is directed to an improved deadbolt lockset in which one of two different backset distances can be selected before installing the lockset in a door. The lockset includes an actuating assembly and a deadbolt mechanism. The deadbolt mechanism includes a hollow latch case which slidably carries a deadbolt, a deadbolt extension, a deadbolt actuator or more specifically a latch cam, and at least one backset side plate. The deadbolt extension is coupled on one end to the deadbolt and on the other end to the latch cam. The side plate is also coupled to the latch cam, which is, in turn, coupled to the actuating assembly when installed in a door. By moving a conversion pin which is coupled to the side plate, the deadbolt extension is uncoupled from the latch cam. The side plate and latch cam are then slid within the latch case, thus changing the backset distance, and the deadbolt extension is recoupled to the deadbolt latch cam. Thus, unlike the prior art, it is the slidable backset side plate assembly and latch cam rather than the deadbolt which are adjustable to provide for a variety of backset distances.

The inner end of the deadbolt is pivotally connected to the slidable deadbolt extension. The backset side plate is apertured to receive one end of a latch cam and a backset conversion pin. The other end of the latch cam is coupled to the deadbolt extension so that rotation of the latch cam causes the deadbolt to be extended or retracted. The latch cam is apertured to receive a tailpiece of the actuating assembly. Rotation of the tailpiece causes the latch cam to rotate within the latch case and thereby extend or retract the deadbolt.

A unique feature of the present invention is that the backset side plate and the latch cam are slidable within the latch case by manual movement of the backset conversion pin. This pin extends from both sides of the latch case. Movement of the backset conversion pin allows the latch cam to slide ⅜", and in so doing, will convert a 2⅜" deadbolt backset into a 2¾" deadbolt backset.

The end of the latch cam coupleable to the bolt extension is apertured to receive a perpendicularly extending bolt drive pin. The bolt drive pin is alternatively coupleable to either of two notches spaced ⅜" apart on the end of the bolt extension. Movement of the backset side plates and the latch cam via movement of the backset conversion pin concomitantly moves the bolt drive pin ⅜" into a different bolt extension notch. The deadbolt backset distance is thus altered without affecting the projected length (bolt throw) of the bolt.

BRIEF DESCRIPTION OF THE DRAWINGS

The invention will now be described with reference to the accompanying drawings wherein.

DESCRIPTION OF THE PREFERRED EMBODIMENT

The following description is of the best presently contemplated mode of carrying out the invention. This description is made for the purpose of illustrating the general principles of the invention and is not to be taken in a limiting sense. The scope of the invention is best determined by reference to the appended claims.

Figure 1:
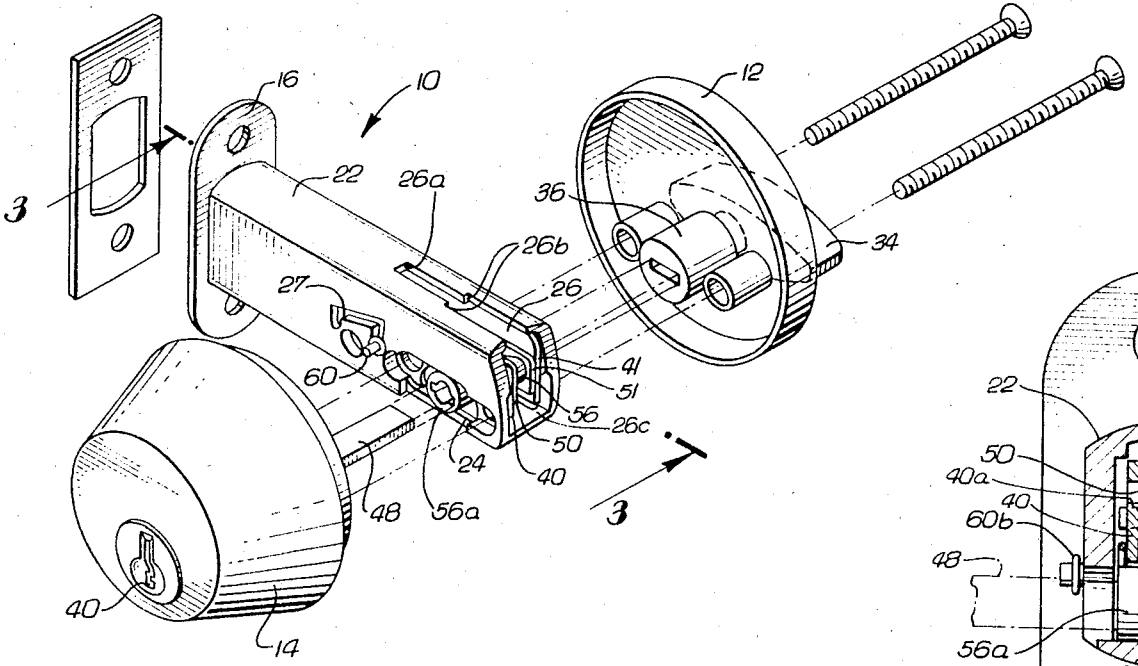
FIG. 1 is an exploded perspective view of the lockset of the present invention with a 2¾" backset.

Referring to FIG. 1, a deadbolt lockset according to the present invention includes a deadbolt mechanism indicated generally at 10, and first and second actuating assemblies indicated at 12 and 14. The deadbolt mechanism 10 includes a planar face plate 16 from which a deadbolt (not shown) extends. The deadbolt mechanism 10 includes a hollow latch case 22 which includes an opening 26 extending from a top forward edge 26*a* to a lower rear end edge 26*c* of the latch case 22. The latch case opening 26 further includes a shoulder 26*b*. The latch case 22 also includes a cam slot 24 which carries an apertured cam post 56*a*, and a backset control slot 27 which carries a backset conversion pin 60. The backset conversion pin 60 is moved within the slot 27 to effect a change in the backset distance.

The first actuating assembly 12 includes a knob or thumbturn 34 from which extends a cylindrical apertured spindle 36. The second actuating assembly 14 includes a lock assembly 40 from which extends a tailpiece 48. The tailpiece 48 extends through the apertured cam post 56*a* into the apertured spindle 36 of the first actuating assembly 12. By turning either the knob 34 or the lock assembly 40, the tailpiece 48 causes a latch cam 56 positioned inside the latch case 22 to rotate. The lock assembly 40 does not form part of the present invention and will therefore not be described in any detail.

Figure 2:
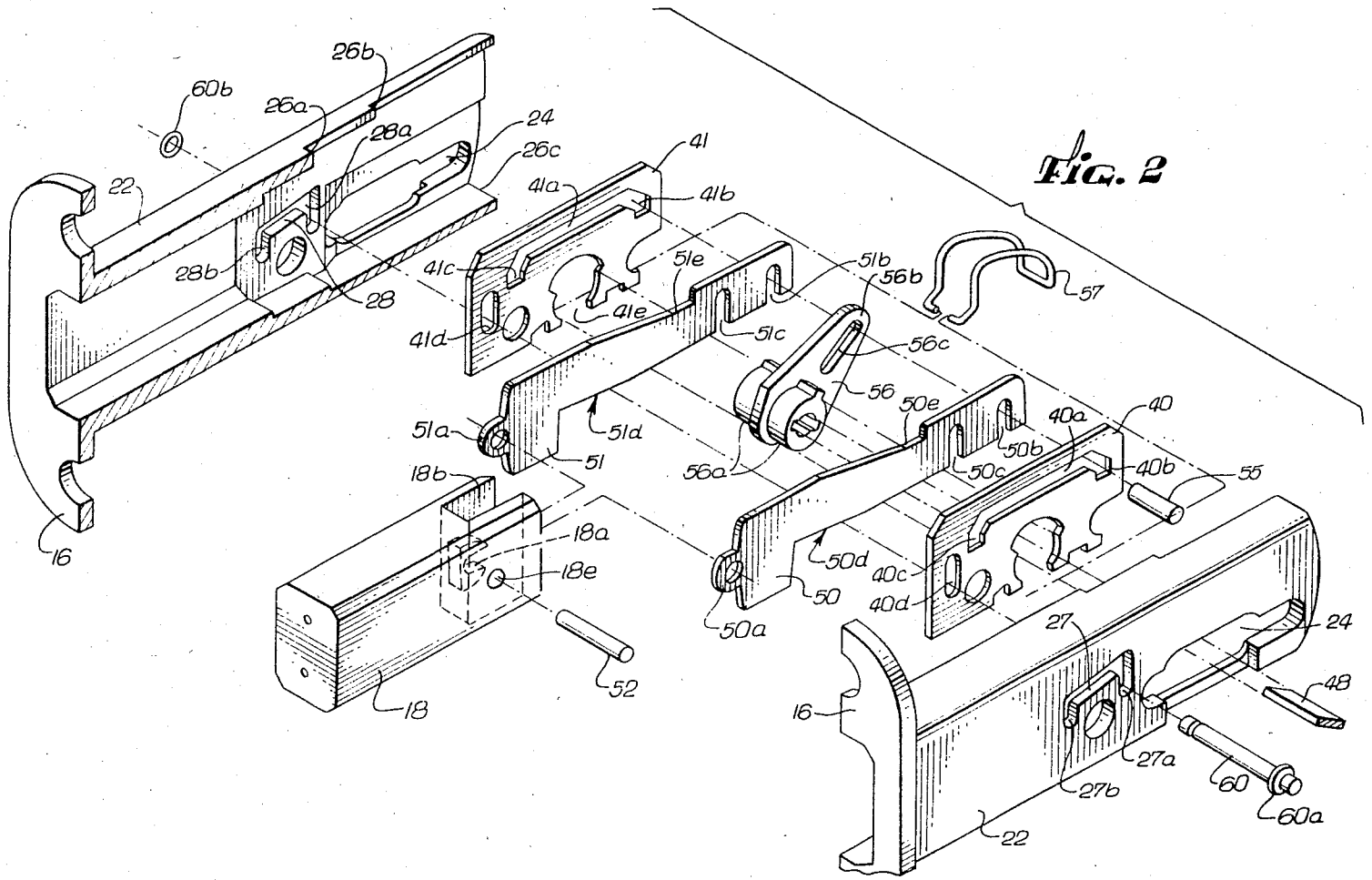
FIG. 2 is an exploded perspective view of the deadbolt mechanism of the present invention with a 2¾" backset.

Referring now to FIG. 2, the construction of the deadbolt mechanism 10 will be described. For purposes of clarity, the actuating assemblies have been omitted from the drawing. In one embodiment of the invention, a deadbolt 18 includes a slotted extension 18*a* contained within a squared deadbolt opening 18*b*. The deadbolt 18 is slidable within the latch case 22 and is coupled to a pair of planar bolt extensions 50 and 51. The bolt extensions 50 and 51 include apertured bolt extension lobes 50*a* and 51*a*, respectively, through which passes a cylindrical bolt linkage pin 52. The bolt linkage pin 52, together with the bolt extension lobes 50*a* and 51*a*, are brought into the deadbolt opening 18*b* and are spaced apart by the legs of deadbolt extension 18*a* of the deadbolt 18. This arrangement is more fully shown in FIGS. 3 and 4. The deadbolt extensions 50 and 51 are slidable within the latch case 22, and are pivotable about the axis defined by the bolt linkage pin 52. The ends of the pin 52 are inserted into a pair of holes 18*e* and 18*f* (FIG. 12) on either side of the deadbolt opening 18*b*. The bolt extensions 50 and 51 each include a $2\frac{3}{4}''$ backset notch 50*b* and 51*b*, spaced from a $2\frac{3}{8}''$ backset notch, 50*c* and 51*c*, respectively.

Figure 3:
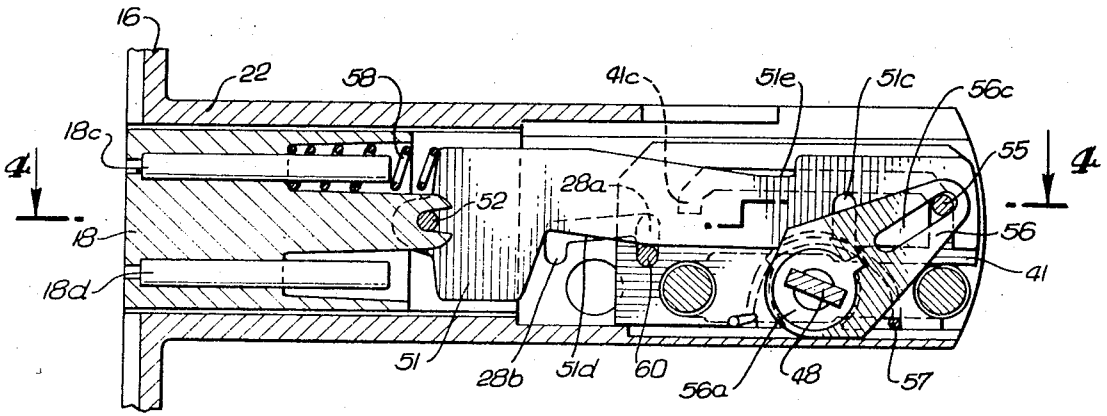
FIG. 3 is a side sectional view of the deadbolt mechanism taken along line 3—3 of FIG. 1 in the retracted position.
Figure 4:
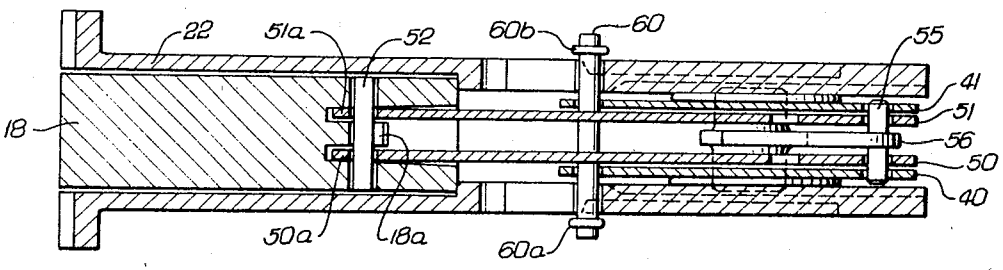
FIG. 4 is a top sectional view of the present invention taken along line 4—4 of FIG. 3.

As shown in FIG. 3, the deadbolt 18 can include two embedded saw-proof pins 18*c* and 18*d*. A compression spring 58 can be coupled at one end to deadbolt 18. The other end of the spring 58 contacts the forward ends of the deadbolt extensions 50 and 51. The force exerted by the spring 58 on the deadbolt extensions biases the deadbolt extensions downward. As is more fully described below, the downward bias of the extensions facilitates the backset conversion operation.

Figure 11:
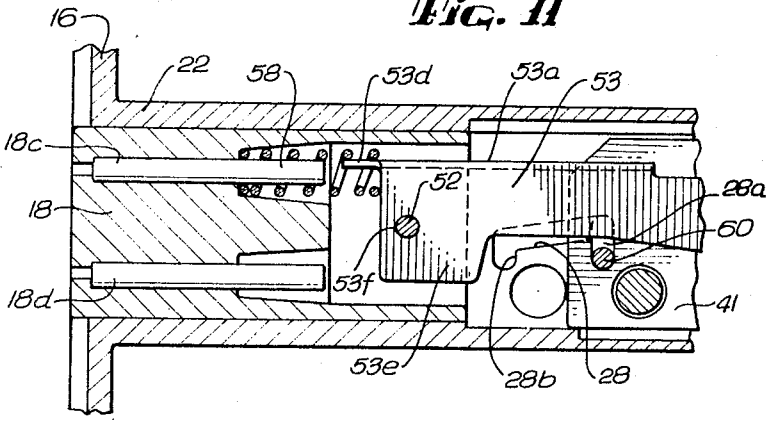
FIG. 11 is a side sectional view of the integral deadbolt extension of the present invention.
Figure 12:
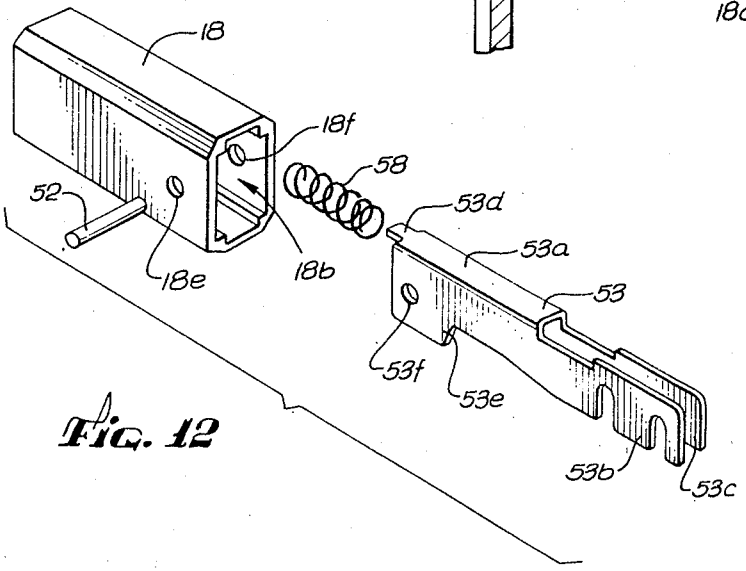
FIG. 12 is an exploded view of the integral deadbolt extension of the present invention.

In another embodiment of the present invention, more fully shown in FIGS. 11 and 12, an integral deadbolt extension 53 having forward portion 53*a* and arms 53*b* and 53*c* can be used instead of the two deadbolt extensions 50 and 51. The integral deadbolt extension 53 is preferred because it provides a more rigid structure than two separate extensions. The arms 53*b* and 53*c* correspond to the notched end portions of the deadbolt extensions 50 and 51, respectively. The forward edge of the forward portion 53*a* of the deadbolt extension 53 includes the outwardly extending projection 53*d*. The compression spring 58 is positioned within the deadbolt opening 18*b* and is connected at one end to the projection 53*d*. The arms 53*b* and 53*c* are downwardly biased due to the force exerted by the spring 58 on the forward portion 53*a*. The spring 58 facilitates operation of the latch cam 56 should the deadbolt mechanism 10 be used upside down. Extending downwardly from the forward portion 53*a* of the extension 53 are a pair of side projections, each of which has a deadbolt linkage pin hole. FIG. 12 shows side projection 53*e* having hole 53*f*. These projections correspond to the lobes 50*a* and 51*a* of the deadbolt extensions 50 and 51, respectively. In this embodiment of the deadbolt extension of the present invention, the deadbolt slotted extension 18*a* is not present since the spacing between the arms 53*b* and 53*c* is fixed. The integral deadbolt extension 53 is coupled to the deadbolt 18 by means of the spring 58 and the positioning of the bolt linkage pin 52 which passes through the deadbolt extension holes and the deadbolt holes.

Referring again to FIG. 2, a pair of planar backset side plates 40 and 41 are located adjacent the bolt extensions 50 and 51 and the inner surface of the latch case 22. Each backset side plate includes a bolt translation slot 40*a* and 41*a*. Each bolt translation slot includes a retraction notch 40*b* and 41*b*, and an extension notch, 40*c* and 41*c*, respectively. The backset side plates 40 and 41 also include an oval backset conversion pin slot 40*d* and 41*d*, respectively, and a semi-cylindrical cam post slot 40*e* and 41*e*, respectively. A cam 56 is positioned so that a cylindrical apertured cam post 56*a*, extending on either side of the cam 56, passes through the cam post slots 40*e* and 41*e* of the backset side plates 40 and 41.

A generally saddle shaped spring 57 is coupled to side plates 40 and 41. The curved portion of the spring 57 contacts the cam post 56*a* and biases the cam post downward. As is more fully described below, the downward bias of the cam post 56*a* facilitates the deadbolt extension operation and the backset conversion operation.

Figure 6:
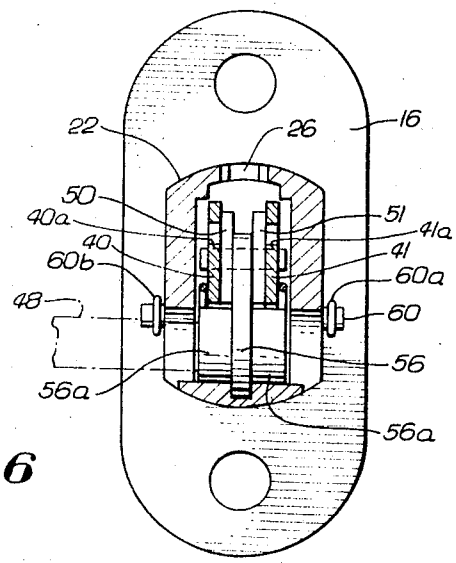
FIG. 6 is a cross sectional view of the present invention taken along line 6—6 of FIG. 5.

The cam 56 includes a cam lobe 56*b* having an oval cam lobe slot 56*c*. A bolt drive pin 55 passes through the bolt translation slot 40*a*, through either of the bolt extension backset notches 50*b* or 50*c*, through the cam lobe slot 56*c*, through the corresponding extension backset notches 51*b* or 51*c*, respectively, and finally through the bolt translation slot 41*a*. The position of these internal components of the deadbolt mechanism is further illustrated in FIGS. 4 and 6.

On each side of the latch case 22 is a backset control slot 27 and 28, each of which includes a $2\frac{3}{4}''$ backset notch 27*a* and 28*a*, and a $2\frac{3}{8}''$ backset notch 27*b* and 28*b*, respectively. A backset conversion pin 60 slidably passes through the backset control slot 27, through the oval backset conversion pin slot 40*d* of the side plate 40, underneath a shoulder 50*d* and a shoulder 51*d* of the bolt extensions 50 and 51, respectively, through the oval backset conversion pin slot 41*d* of the side plate 41, and finally through the backset control slot 28. The backset conversion pin 60 is maintained in position by retainer rings 60*a* and 60*b*, and can be moved to cause the side plates 40 and 41 to slide within the latch case 22. The ends of the conversion pin 60 can include an enlarged portion instead of the rings 60*a* and 60*b*.

Figure 5:
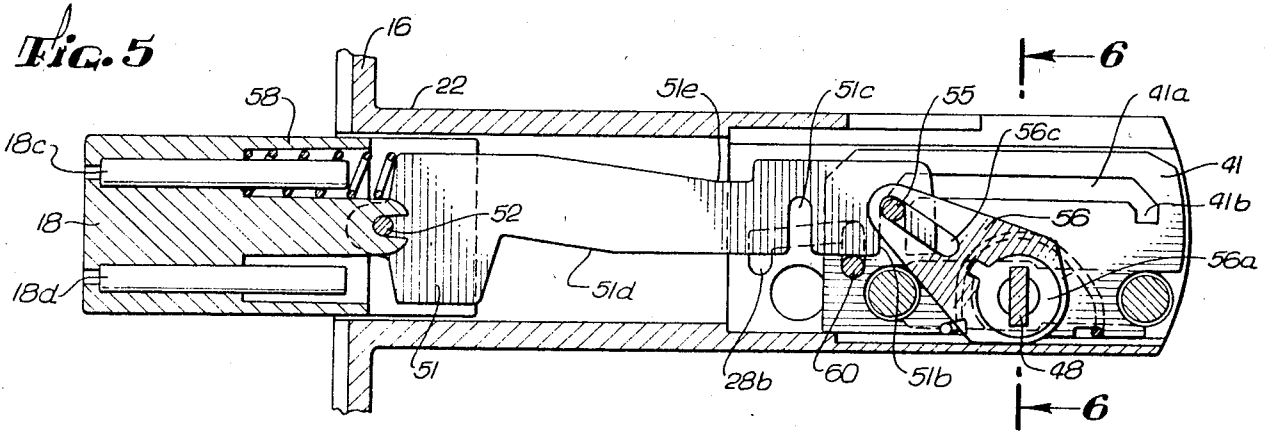
FIG. 5 is a side sectional view of the present invention showing the deadbolt in an extended position.

Referring to FIGS. 3 and 5, the operation of the deadbolt assembly will be described with respect to the 2¾" backset distance. If either the locking assembly 40 of the second actuating cylinder assembly 14 or the knob 34 of the first actuating assembly 12 is turned, the tailpiece 48 will rotate, causing the cam 56 to rotate about an axis defined by the cam post 56*a*. The rotation of the cam 56 causes the bolt drive pin 55 to press against the 2¾" bolt extension backset notches 50*b* and 51*b*. This, in turn, causes the bolt extensions 50 and 51 to simultaneously slide forward within the latch case 22 and push against the bolt linkage pin 52 causing the deadbolt 18 to extend as shown in FIG. 5. As the cam 56 rotates, the bolt drive pin 55 is moved within the bolt extension translation slots 40*a* and 41*a*, from the retraction notches 40*b* and 41*b* to the extension notches 40*c* and 41*c*, respectively. The downward bias exerted by the springs 57 and 58 facilitates positioning of the bolt drive pin 55 in the extension and retraction notches. The springs 57 and 58 further prevent the bolt drive pin 55 from coming out of the extension and retraction notches during extension and retraction of the deadbolt 18.

Figure 7:
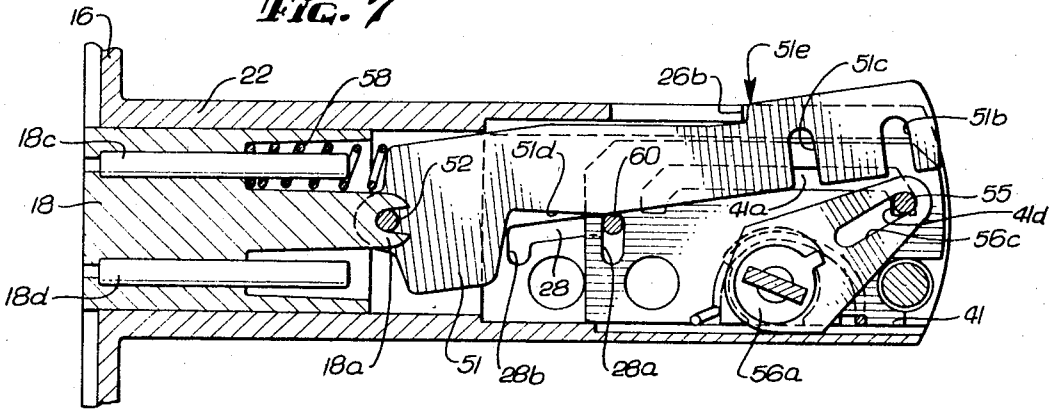
FIG. 7 is a side sectional view of the present invention showing movement of the backset conversion pin.

Referring now to FIGS. 7, 8, 9 and 10, the backset conversion operation will be described. When it is desired to provide the shorter backset distance, e.g., 2⅜", the ends of the backset conversion pin 60 are manually grasped and the pin is first lifted straight upwards within the 2¾" backset control slots 27*a* and 28*a*. This movement of the pin 60 is illustrated in FIG. 7. As this occurs, the backset conversion pin 60 moves upwards within the oval backset conversion pin slots 40*d* and 41*d* the pin 60 to contact the lower shoulders 50*d* and 51*d* of the bolt extensions 50 and 51. The upward force exerted by the pin 60 on the lower shoulders 50*d* and 51*d* causes both of the extensions to be raised until top shoulders 50*e* and 51*e* of the bolt extensions 50 and 51 contact shoulder 26*b* of the latch case 22. The shoulder 26*b* limits the upward motion of the deadbolt extensions 50 and 51 or the corresponding arms 53*b* and 53*c* of the integral deadbolt extension 53. The limited upward movement prevents the extensions from completely uncoupling from the side plates 40 and 41. The shoulder 26*b* also prevents the extensions from moving longitudinally forward as the side plates and latch cam are moved during the backset conversion operation. The downward bias exerted by the spring 57 on the cam post 56*a* holds the bolt drive pin 55 in the side plate notches while the extensions are being upwardly moved.

Figure 8:
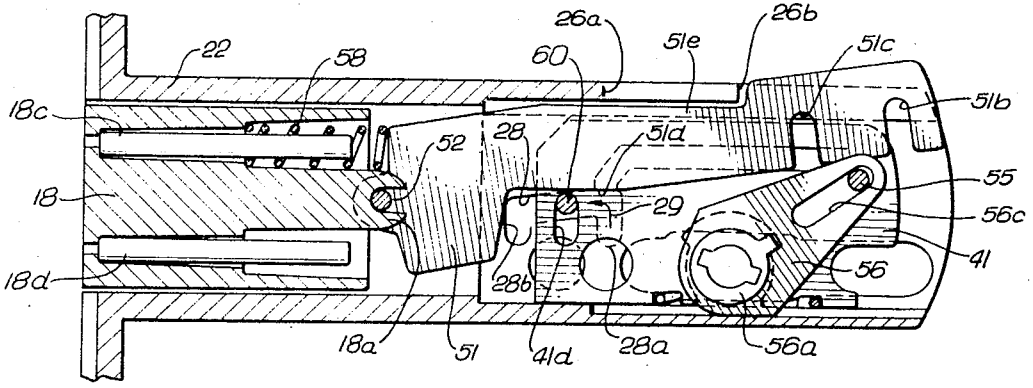
FIG. 8 is a side sectional view of the present invention also showing movement of the backset conversion pin.
Figure 9:
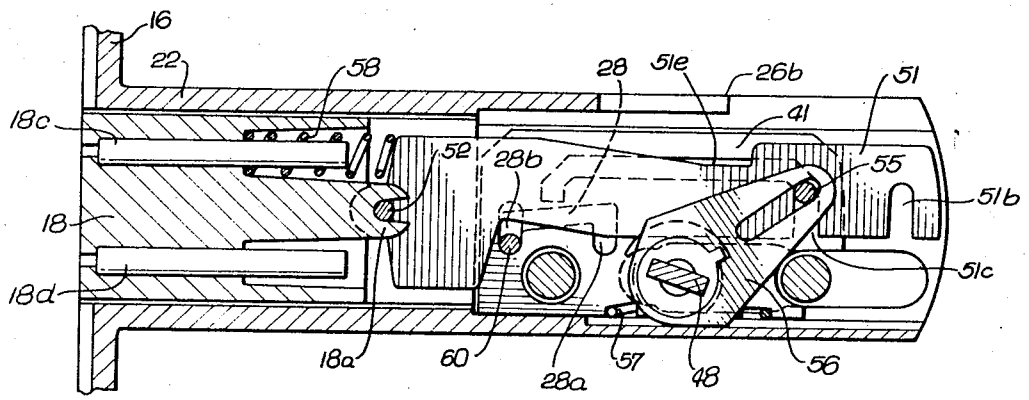
FIG. 9 is a side sectional view of the deadbolt mechanism of the present invention showing the 2⅜" backset.
Figure 10:
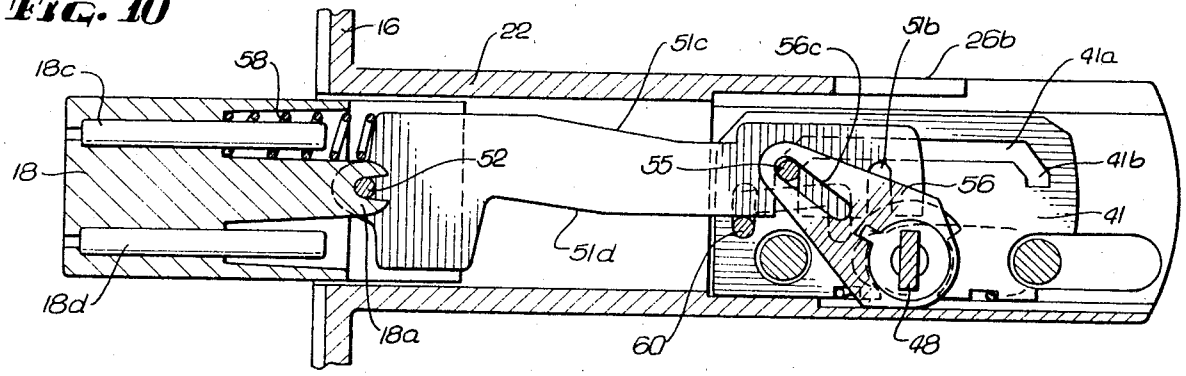
FIG. 10 is a side sectional view of the present invention showing the deadbolt in an extended position with a 2⅜" backset.

Upward movement of the pin 60 causes the bolt drive pin 55 to be disengaged from the 2¾" backset notches 50*b* and 51*b* of the bolt extensions 50 and 51. As shown in FIG. 8, the backset conversion pin 60 is then moved forward along the backset control notches 27 and 28 towards the 2⅜" backset notches 27*b* and 28*b*. This movement is indicated by an arrow 29. As the backset conversion pin 60 is moved within the backset control slots 27 and 28, the backset control side plates 40 and 41, together with the cam 56, slide forward within the latch case 22. As is illustrated in FIG. 9, the backset conversion pin 60 is then lowered within the 2⅜" backset notches 27*b* and 28*b*. The bolt extensions 50 and 51 are simultaneously lowered, thereby engaging the bolt drive pin 55 with the 2⅜" backset notches 50*c* and 51*c*. As shown in FIG. 10, the deadbolt 18 can then be extended via rotation of the latch cam 56. Thus, by the simple movement of the backset control side plates 40 and 41 via the backset conversion pin 60, and the repositioning of the bolt drive pin 55 from the 2¾" backset notches 50*b* and 51*b* to the 2⅜" backset notches 50*c* and 51*c*, the backset distance is changed from 2¾" to 2⅜". Thus, the provision of two different backsets in a single assembly is facilitated by providing the slidable backset control side plates 40 and 41.

The present invention thus provides a single assembly which can be constructed with one of two (or more) different backset distances. The assembly is quite simple, and selection of the different backset distances is facilitated by the simple movement of the backset conversion pin and repositioning of the bolt drive pin with respect to the deadbolt extensions. It should be appreciated that various modifications will occur to those skilled in the art without departing from the scope and spirit of the invention.

We claim:

1. A deadbolt lockset having a selectable backset distance comprising:

a hollow latch case assembly;

a deadbolt slidably carried within the latch case assembly and moveable between an extended and a retracted position;

actuator means for extending and retracting the deadbolt;

a deadbolt extension slidably carried within the latch case assembly and coupled at one end to the deadbolt, the other end of the deadbolt extension including first and second spaced openings;

coupling means for coupling the actuator means to the deadbolt extension; and adjustment means for guiding the actuator means from a first location within the latch case in which the coupling means is coupled to the first deadbolt extension opening to provide a first backset distance to a second location within the latch case in which the coupling means is coupled to the second deadbolt extension opening to provide a second backset distance, wherein at each of the first and second locations the actuator means is operable to extend or retract the deadbolt, and wherein the latch case assembly includes a pair of backset control slots disposed opposite each other on either side of the latch case and wherein the adjustment means includes a pin coupled to the actuator assembly, wherein said pin passes through the backset control slots and extends from each side of the latch case assembly, wherein movement of the pin within the slots changes the backset distance.

2. A deadbolt lockset according to claim 1 wherein the actuator means includes a pivotal hub and an extension which extends from the hub and is coupled to the coupling means, wherein pivoting of the hub operates to extend and retract the deadbolt.

3. A deadbolt lockset according to claim 2 wherein the adjustment means includes at least one backset side plate slidably carried within the latch case assembly, wherein the hub is carried by the said side plate and the pin is coupled to the side plate, wherein movement of the pin within the control slots slides the side plate and hub within the latch case.

4. A deadbolt lockset having a selectable backset distance comprising:

a hollow latch case assembly having a pair of backset control slots disposed opposite each other on either side of the latch case, each of the slots having a first end and a second end;

a deadbolt slidably carried within the latch case assembly and moveable between an extended and a retracted position;

a first means for extending and retracting the deadbolt having a first end and a second end;

at least one deadbolt extension slidably carried within the latch case assembly, the extension connected at one end to the deadbolt, the other end of the deadbolt extension including first and second spaced openings;

at least one backset side plate slidably carried within the latch case assembly and coupled to the first end of the first means;

a second means for coupling the second end of the first means to the deadbolt openings;

a pin extending through the backset control slots and coupled to the backset side plate, wherein in a first position the pin is positioned at the first end of the backset control slots thereby providing a first backset distance; and, in a second position, the pin is positioned at the second end of the backset control slots thereby providing a second backset distance, and wherein at each position, operation of the first means will extend or retract the deadbolt.

5. A deadbolt lockset according to claim 4 further including an actuator assembly having an extension couplable to the first means wherein rotation of the extension causes the first means to extend and retract the deadbolt.

6. A deadbolt lockset according to claim 4 wherein the backset side plate further includes an opening for receiving the pin.

7. A deadbolt lockset according to claim 6 wherein upward movement of the pin within the opening of the backset side plate causes the second means to be uncoupled from the deadbolt extension.

8. A deadbolt lockset having a selectable backset distance comprising:

a hollow latch case assembly, the latch case assembly including a pair of backset control slots disposed opposite each other on either side of the latch case;

a deadbolt slidably carried within the latch case assembly and movable between an extended and a retracted position;

actuator means for extending and retracting the deadbolt;

a deadbolt extension slidably carried within the latch case assembly and coupled at one end to the deadbolt, the other end of the deadbolt extension including first and second spaced opening;

coupling means for coupling the actuator means to the deadbolt extension; and adjustment means for guiding the actuator means within the latch case from a first location in which the coupling means is coupled to the first deadbolt extension opening to provide a first backset distance to a second location in which the coupling means is coupled to the second deadbolt extension opening to provide a second backset distance, the adjustment means including a pin coupled to the actuator assembly, the pin passing through the backset control slots and extending from each side of the latch case assembly, wherein movement of the pin within the slots changes the backset distance and wherein at each of the first and second locations the actuator means is operable to extend or retract the deadbolt.

9. A deadbolt lockset according to claim 8 wherein the actuator means includes a pivotal hub and an extension which extends from the hub and is coupled to the coupling means, where pivoting of the hub operates to extend and retract the deadbolt.

10. A deadbolt lockset according to claim 9 wherein the adjustment means includes at least one backset side plate slidably carried within the latch case assembly, wherein the hub is carried by the said side plate and the pin is coupled to the side plate, wherein the movement of the pin within the control slots slides the side plates and the hub within the latch case.

11. A deadbolt lockset having a selectable backset distance comprising:

a hollow latch case assembly;

a deadbolt slidably carried within the latch case assembly and movable between an extended and a retracted position;

actuator means for extending and retracting the deadbolt;

a deadbolt extension pivotally attached to the deadbolt, the deadbolt extension having at least two slots spaced at different distances from the deadbolt;

a side plate disposed within the latch case assembly;

a coupling pin extending from the side plate to the actuator, with one deadbolt extension slot engaging the coupling pin; and an adjuster pin extending under the deadbolt extension, the adjuster pin movable in a first direction generally perpendicular to the direction of movement of the deadbolt to move the deadbolt extension and disengage it from the coupling pin, and movable in a second direction generally parallel to the direction of movement of the deadbolt to move the side plate and hence the coupling pin in the direction of extension or retraction of the deadbolt and then movable in a direction opposite the first direction to allow another deadbolt extension slot to engage the coupling pin.

* * * * *